United States Patent [19]

Dow

[11] 4,146,044

[45] Mar. 27, 1979

[54] APPARATUS FOR REMOVING RESIDUAL ELEMENTS FROM A STORAGE TANK

[76] Inventor: Russell T. Dow, 200 Suydam La., Bayport, N.Y. 11705

[21] Appl. No.: 813,870

[22] Filed: Jul. 8, 1977

[51] Int. Cl.[2] ..... B08B 3/02; B08B 9/08

[52] U.S. Cl. ..... 134/104; 134/113; 134/169 R; 134/171; 134/182

[58] Field of Search ..... 134/104, 113, 166 R–169 R, 134/182–183, 22 R, 24, 154, 171, 111

[56] References Cited

U.S. PATENT DOCUMENTS

| | | | |
|---|---|---|---|
| 2,733,723 | 2/1956 | Whitcomb | 134/168 R X |
| 3,067,759 | 12/1962 | Guth et al. | 134/182 X |
| 3,177,095 | 4/1965 | Gibson | 134/183 X |
| 3,182,669 | 5/1965 | Campbell et al. | 134/167 R X |
| 3,375,835 | 4/1968 | Lopp et al. | 134/183 X |
| 3,398,023 | 8/1968 | Jacobsen et al. | 134/113 X |
| 3,815,625 | 6/1974 | Weise | 134/166 R X |
| 3,856,570 | 12/1974 | McDermott | 134/167 R X |

FOREIGN PATENT DOCUMENTS

| | | | |
|---|---|---|---|
| 2250290 | 4/1974 | Fed. Rep. of Germany | 134/169 R |

*Primary Examiner*—Robert L. Bleutge
*Attorney, Agent, or Firm*—Kevin Redmond

[57] ABSTRACT

A nozzle located within an access port of a fuel storage tank, directs a solvent spray at the inner surfaces of the tank and at a deflection plate designed to redirect the spray at areas within the tank that are inaccessible to the direct spray from the nozzle. The deflection plate includes a convex inner surface and a concave outer surface to redirect the spray to a number of diversely located areas.

4 Claims, 4 Drawing Figures

APPARATUS FOR REMOVING RESIDUAL ELEMENTS FROM A STORAGE TANK

BACKGROUND

1. Field

This invention relates to the removal of residue, such as varnish, from fuel storage tanks and, in particular, from aircraft storage tanks which often include areas which cannot be reached by a direct spray from a nozzle located near the tank access port.

2. Prior Art

One common method used to clean an aircraft wing tank is to loosen the residue with a solvent and then scrub the tank by hand with a brush. In carrying out this method, the operator is often required to place his head in or near the tank access port to view his progress and to reach points at some distance from the access port. The strong fumes from the solvent tend to make the operator unconscious, making this work dangerous, tedious and costly. In addition, the working space surrounding the access port, such as an aircraft hangar area, fills with these fumes.

Attempts have been made to overcome these problems. In particular, K. R. Witcomb in U.S. Pat. No. 2,733,723, shows a bar type spray nozzle extending through several wing ribs with multiple ports to spray solvent in a number of diverse directions. A single collection port is used to drain the solvent. Unfortunately, the wing ribs in a number of modern aircraft do not have clear areas which would enable a pipe nozzle to be passed through several ribs in a straight line, nor is the access port always sufficiently wide to permit such a nozzle to be placed within the wings. For the wings to accommodate a long nozzle, it must be constructed of sections that can fit through the access port for reassembly within the wings . The reassembly is usually inconvenient and, in some cases, awkward or impossible. In addition, some aircraft have areas which are inaccessible to the spray emanating directly from such a nozzle, resulting in an incomplete cleaning that must be corrected by resorting to manual methods which defeats the purpose of the system.

This prior art system drains the solvent from a low point on the wing. This causes solvent and residue to become trapped along the wing structure before reaching the drain port. No solvent is drained from the access port through which the nozzle is placed. Usually the nozzle feed line is smaller than the access port and to prevent solvent from leaking about this port requires a special fitting.

SUMMARY

An object of the present invention is to provide an automatic tank residue removal system capable of reaching areas generally inaccessible to a direct spray from a nozzle located near the tank access port. Another object is to provide a system with a relatively small nozzle which can be easily placed through the access port and requires no further assembly. Another object is to eliminate the need for plugging the access port and draining the solvent from a drain port. Still another object is to provide a vapor free work or hangar area and provide means to monitor the pressure and temperature of the solvent.

In the present invention, the spray is directed over a wide area from a single, relatively small nozzle head. A portion of the spray is directed at a deflection plate which includes a convex surface in its central area and a concave surface in its outer area. The portion of the spray impinging on the deflector is redirected in a number of paths at areas inaccessible to the direct spray from the nozzle.

A trough, with edges which contact the underside of the wing surface about the access port, collects the spent solvent and redirects it to a filtration system for reprocessing.

DETAILED DESCRIPTION OF THE INVENTION

Figure 1:
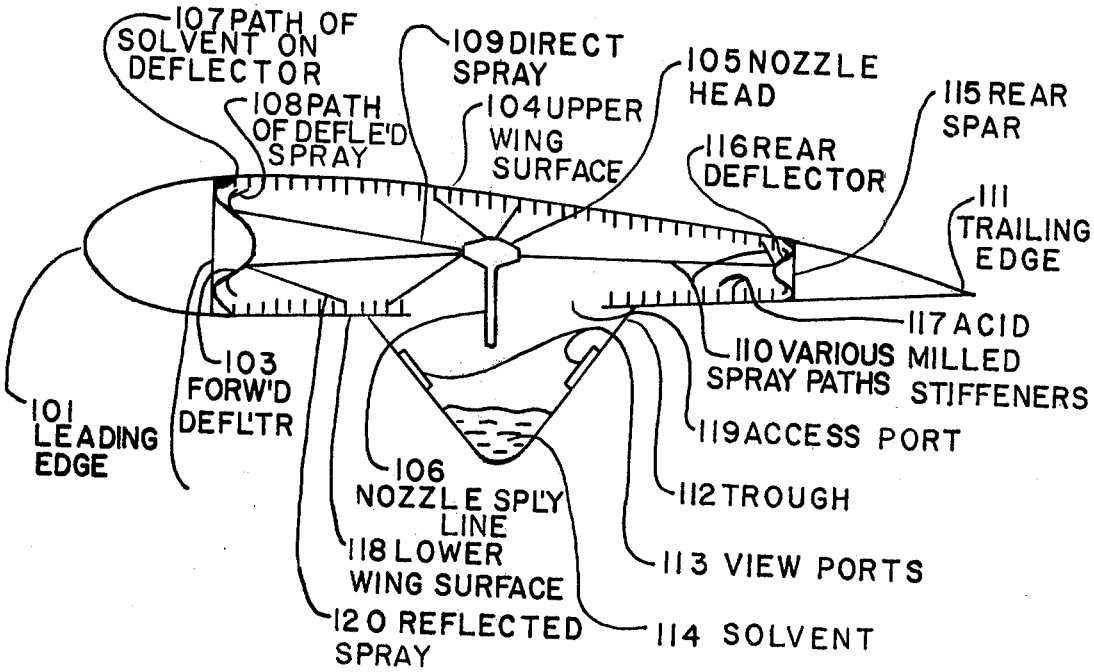
FIG. 1 is a cross sectional side view of a wing tank.

FIG. 1 shows a wing section with an internal fuel tank comprising a leading edge 101, a forward spar 102, an upper wing surface 104, a rear spar 115, a trailing edge 111, acid milled stiffeners 117, a lower wing surface 118, and an access port 119 located in the lower wing surface.

This Figure also shows a fuel tank cleaning system comprising a nozzle head 105, a nozzle supply line 106, a forward deflector 103, a rear deflector 116, and a generally "V" shaped trough 112. The trough contains view ports 113 and holds solvent 114 drained from the fuel tank through the access port. The wide trough more than covers the access port area and the edges of the trough closely contact the lower surface of the wing to make it virtually impossible to leak the solvent. The view ports make possible inspection of the cleaning operation without leaking fumes or solvent.

In the operation of the system shown in FIG. 1, solvent under pressure is sprayed from the nozzle head 105 in various directions as shown by the spray lines 110. The spray can be directed at most of the inner surfaces of the tank, but some of the areas, such as those behind the acid milled stiffeners located near the forward and trailing edges, cannot be reached directly because the stiffeners mask these areas. To overcome this problem, specially shaped deflection plates, such as plates 103 and 116, are inserted at either end of the tank, as shown.

A portion of the spray from the nozzle head is directed at the convex center portion of the deflection plate, as shown by direct spray line 109. A portion of the incident spray spatters off the surface and is redirected to the rear side of the acid milled stiffeners, as shown by reflected spray line 120.

The lower velocity portion of the solvent impinging on the deflection plate is guided by the convex surface to the inaccessible portions of the acid milled stiffeners located near the leading and trailing edges, as shown by the solvent path 107. Raised projection, referred to herein as deflection lips, located on the deflection plate are used to direct the solvent to various other inaccessible areas, as shown by solvent path 108.

Figure 4:
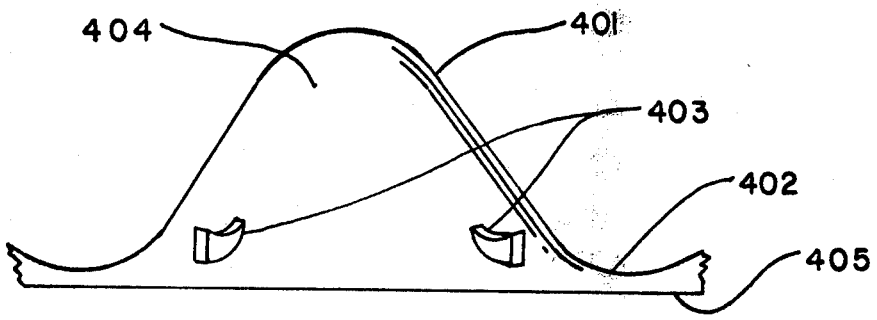
FIG. 4 is a detailed drawing of the deflection plate.

The deflection lips are shown in greater detail in FIG. 4. In this Figure, a deflection plate 404 is shown to contain a convex surface 401 and a concave surface 402 and deflection lips 403. A spar 405 is shown for reference purposes.

It should be noted that a rotating or oscillating spray head may be used to provide additional coverage and agitation of the spray for additional cleaning action.

Figure 2:
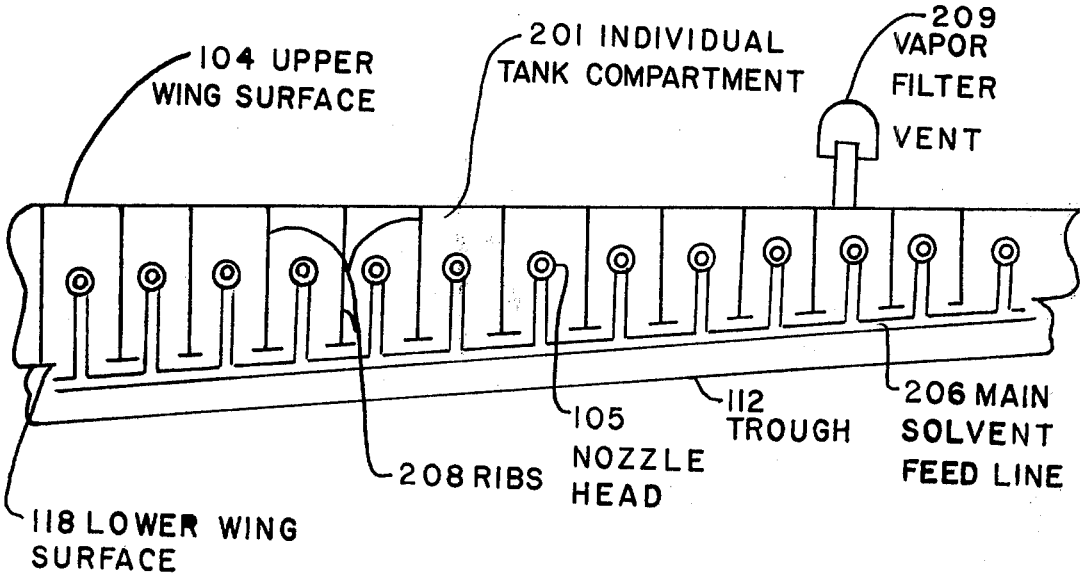
FIG. 2 is a cross sectional front view of a wing tank.

FIG. 2 shows a front view of the wing comprising an upper wing surface 104, a vapor filtered vent 209 located on the upper surface designed to prevent differential from developing inside the wing, a lower wing surface 118, and ribs 208 dividing the wing into numerous individual tank compartments such as compartment 201.

Within each compartment a separate nozzle head is located such as head 105. The nozzles are all fed from a single main solvent feed line 206 located in the trough 112 which extends under the entire being cleaned to collect the solvent draining from the access port of each compartment.

Figure 3:
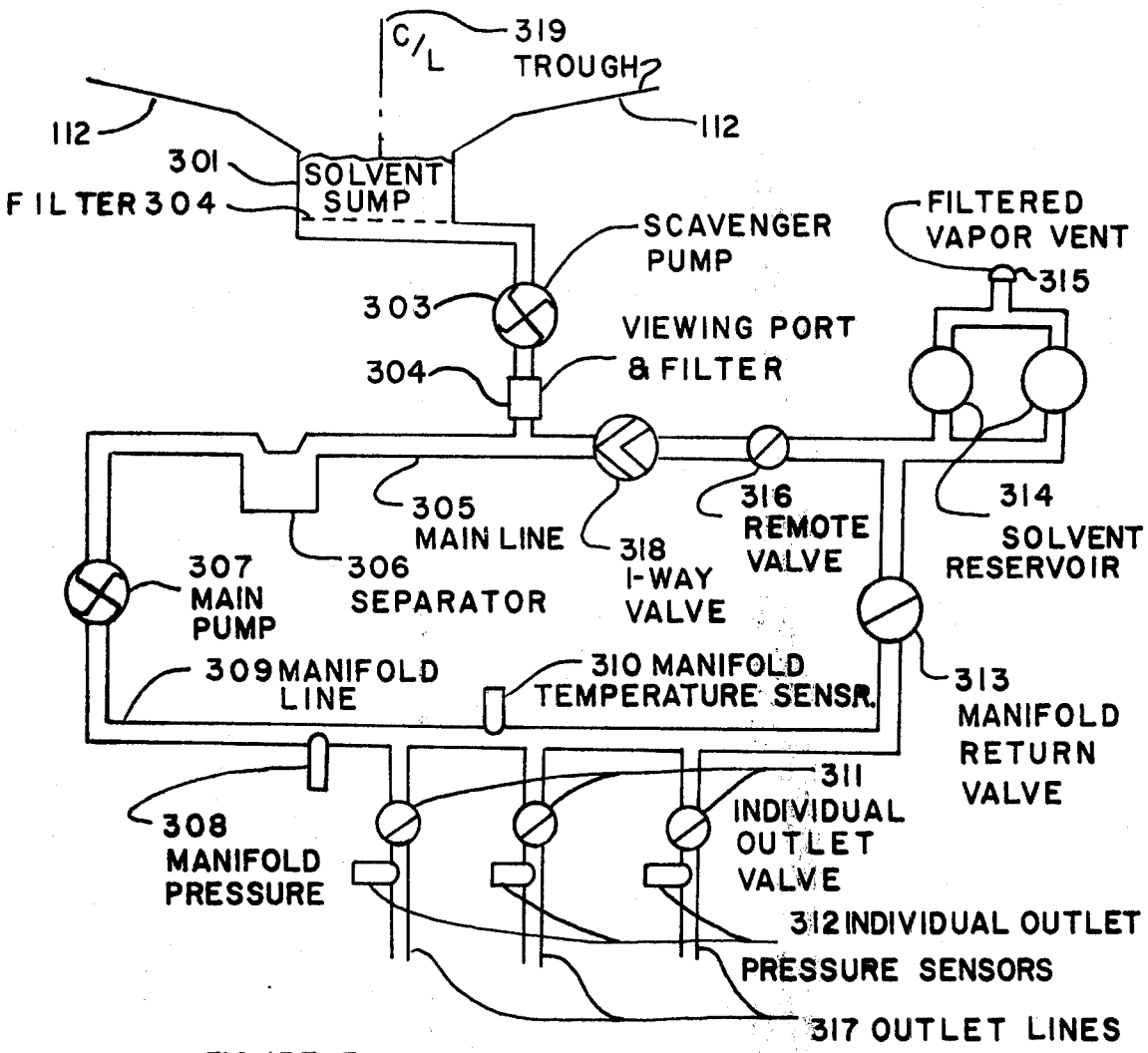
FIG. 3 is a process flow diagram of a solvent filtration system.

FIG. 3 shows the filtration system used to reprocess the solvent after it has been collected by the trough. This system comprises a solvent sump 301, a solvent filter 302, a scavenger pump 303, a view port and filter 304, a main solvent line 305, a separator 306, a main pump 307, a manifold line 309, a manifold pressure sensor 308, a manifold temperature sensor 310, a plurality of outlet lines 317, individual outlet valves 311, individual outlet pressure sensors 312, a manifold return pump 313, a filtered vapor vent 315, solvent resovoirs 314, remote valve 316 and one-way valve 318. The trough 112 and the aircraft center line 319 are shown for reference purposes.

In the operation of the system shown in FIG. 3, solvent collected from the trough is fed to the sump 301, where it is then passed through the filter 307, the scavenger pump 303, the viewing port 304, the main solvent line 305, the separator 306, the main pump 307, the manifold 309 to the individual outlet lines 317. The individual outlet lines feed the main solvent feed lines leading to a series of spray head such as shown in FIG. 2. Solvent not required to supply the outlet lines is recirculated through the manifold return valve 313, the remote valve and the one-way valve to the main solvent line. When additional solvent is required, it is drawn from the solvent resorvoirs 314.

This system has a number of important safety features. Operators may monitor the readings of the temperature and pressure sensors to precisely control the operation of the system and thus avoid possible dangers, such as exceeding the flash point of the solvent. The pressure sensors 308 automatically shuts the system off if a preset level of over pressure, indicating a system malfunction, is detected.

I claim:

1. Apparatus for removing residual elements from a storage tank having an access port and areas within the tank that are not accessible to a direct spray emanating from the vicinity of the access port, comprising:

(a) a source of solvent, (b) a spray nozzle located in the vicinity of the access port for applying the solvent under pressure to the insides of the tank to remove the residual elements, said nozzle is essentially fixed in position and the spray is directed by said nozzle over a wide area including the insides of the tank and the deflection plate, (c) means for delivering the solvent to the nozzle under pressure, (d) a deflection plate located at one end of the tank, said plate having a concave and a convex surface to receive a portion of the spray of solvent from the nozzle and redirect it at the portions of the tank that are inaccessible to a direct spray from the nozzle, said deflection plate is convex in its central area and concave in its peripheral area, and (e) a concave lip projection on said convex area of the deflection plate to direct the spray at a specific inaccessible area.

2. Apparatus for removing residual elements from a storage tank having an access port and areas within the tank that are not accessible to a direct spray emanating from the vicinity of the access port, comprising:

(a) a source of solvent, (b) a spray nozzle located in the vicinity of the access port for applying the solvent under pressure to the insides of the tank to remove the residual elements, said nozzle is essentially fixed in position and the spray is directed by said nozzle over a wide area including the insides of the tank and the deflection plate, (c) means for delivering the solvent to the nozzle under pressure, and (d) a deflection plate located at one end of the tank, said plate having a concave and a convex surface to receive a portion of the spray of solvent from the nozzle and redirect it at the portions of the tank that are inaccessible to direct spray from the nozzle, said deflection plate is convex in its central area and concave in its peripheral areas said access port is located on the underside of said tank and said apparatus further comprises a trough located beneath said access port to collect solvent drained from said access port.

3. Apparatus as claimed in claim 2, wherein said trough is generally "V" shaped with its opening extending beyond the access port in the lateral direction and along under other similar access ports in the longitudinal direction and said trough having its edges contacting the surface of the tank to provide a leak free means of collecting the solvent.

4. Apparatus as claimed in claim 3, wherein said trough further comprises sealed inspection viewing ports to permit inspection of the tank without leaking fumes to the working area.

* * * * *